US011220864B1

(12) United States Patent
Abbisso

(10) Patent No.: US 11,220,864 B1
(45) Date of Patent: Jan. 11, 2022

(54) PANELS OR THE LIKE FOR LADDER SAFETY DEVICE

(71) Applicant: Leonard J Abbisso, Dedham, MA (US)

(72) Inventor: Leonard J Abbisso, Dedham, MA (US)

( * ) Notice: Subject to any disclaimer, the term of this patent is extended or adjusted under 35 U.S.C. 154(b) by 313 days.

(21) Appl. No.: 16/396,654

(22) Filed: Apr. 27, 2019

Related U.S. Application Data

(60) Provisional application No. 62/762,317, filed on Apr. 30, 2018.

(51) Int. Cl.
*E06C 7/00* (2006.01)

(52) U.S. Cl.
CPC ..... *E06C 7/006* (2013.01); *E06C 7/003* (2013.01)

(58) Field of Classification Search
CPC ..... E06C 7/006; E06C 7/003
See application file for complete search history.

(56) References Cited

U.S. PATENT DOCUMENTS 3,311,195 A * 3/1967 Singer ..... E06C 7/18 182/230
4,126,206 A 11/1978 Becnel
4,450,937 A * 5/1984 Broughton ..... E06C 1/16 182/106
5,421,428 A 6/1995 Ingles
5,441,126 A 8/1995 Orrick
5,575,353 A * 11/1996 Cafaro ..... E06B 9/02 160/24
6,516,546 B1 * 2/2003 Bremick ..... E06C 7/006 182/129
7,717,231 B2 5/2010 Horton
7,793,759 B1 * 9/2010 Aiken, Jr. ..... E06C 7/006 182/106
8,191,681 B2 * 6/2012 Lipniarski ..... E06C 7/006 182/106
8,505,687 B2 * 8/2013 Allam ..... E06C 7/006 182/106
8,584,409 B1 * 11/2013 Hibbard ..... E06C 7/006 52/186
8,997,929 B1 * 4/2015 Todd ..... E06C 7/006 182/115
9,828,801 B1 11/2017 Abbisso
2013/0117923 A1 5/2013 Toner
2015/0368968 A1 11/2015 Smith

FOREIGN PATENT DOCUMENTS

DE 202011102506 U1 * 10/2011 ..... E06C 7/006
WO WO-2006111050 A1 * 10/2006 ..... E06C 9/08
WO WO-2013110572 A1 * 8/2013 ..... E06C 7/006
WO WO-2020217053 A1 * 10/2020 ..... E06C 7/006

* cited by examiner

*Primary Examiner* — Colleen M Chavchavadze

(57) ABSTRACT

A safety device having multiple panels for preventing and/or warning persons not to climb thereon; the safety device comprises multiple panels with a housing as necessary, hooks connecting the housing or panels to rungs or side rails of a ladder if appropriate; the panels may be an accordion style panel, or a scissors style panel or a chain-link style panel, having one or more hooks connecting the panels to rungs or side rails of ladders if appropriate.

2 Claims, 4 Drawing Sheets

PANELS OR THE LIKE FOR LADDER SAFETY DEVICE

CROSS-REFERENCES TO RELATED APPLICATIONS

This application claims priority to provisional patent application 62/762,317, filed Apr. 30, 2018, entitled, "Panels for Ladder Safety Device", by the same inventor. See U.S. Pat. No. 9,828,801 issued Nov. 28, 2017 by the same inventor.

Reference to Federally sponsored research or development: NA

Reference to joint research agreements: NA

Reference to Sequence Listing: NA

BACKGROUND OF THE INVENTION

Field of the Invention

The present invention relates generally to safety devices for ladders, and relates more particularly to panels for use on, the safety devices.

Description of the Prior Art

The use of devices for accessing heights above one's reach are well known. This problem occurs both in a residential and construction settings. One device of general use is the folding step ladder or extension ladder. The typical extension ladder is made of aluminum, but fiberglass is also used. The extension ladder combines two sliding sections together. The extension ladder is about 1.5 feet in width, can range in height up to 30 or more feet, and with rungs about 1 foot apart. When left in the standing position, it Presents an attractive nuisance to children, in particular, but others may attempt to use the ladder to gain access to a building and remove construction materials. This problem has been addressed by several devices as noted below.

The Accuform Signs ladder shield kit shows a flexible panel secured to ladder rungs by a cable and lock through grommets in the panel back. The panel rolls up on itself when not in use.

Several patents address this problem:

U.S. Pat. No. 7,717,231 shows a ladder guard having a plurality of panels that overlap to prevent the use of the rungs and can be adjusted to allow the use of the rungs. It is connected to the ladder when not in use. The additional weight at one end of the ladder may cause it to become unstable when being moved.

U.S. Pat. No. 5,575,353, although not being a ladder invention, shows a device like for use in blocking the use of stairs in a house with a flexible sheet thereon deployed therefrom. Adjustable rods like in shower curtains allow for placement on stair side rails of varying widths.

U.S. Pat. No. 5,441,126 shows a semi-rigid shell placed over the front of extension ladder sections and temporarily deployed thereon.

U.S. Pat. No. 5,421,428 shows a metal sheet covering rungs and hooked over a top and bottom rung.

U.S. Pat. No. 4,126,206 shows two sheets placed over rungs and locked thereto to prevent access.

All references are incorporated herein as to their teachings.

Accordingly, there is a need for a device for use upon extension ladders that is readily available for use and can be stored thereon without interference with climbing thereon.

SUMMARY OF THE INVENTION

The present invention is directed at different safety devices having panels that can be used on a ladder safety device or other climbing devices.

As seen in the '801 patent, a flexible solid panel is stored in a rectangular container and connected to the ladder rungs by hooks. The panel is removed through a horizontal slot therein. The end of the panel is connected by hooks to an upper ladder rung. Although a flexible solid panel can be used as shown, other types of panels such as an accordion panel, a scissors panel and a chain-link panel may be adapted for various climbing devices as described herein.

An object of the present invention is to provide a ladder safety device with optional panels.

It is another object of the present invention to provide optional panels that may present more visible means to a possible climber.

It is another object of the present invention to provide a ladder safety device having panels sufficient in size to block climbing and further provide space for advertising and warnings.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Figure 1:
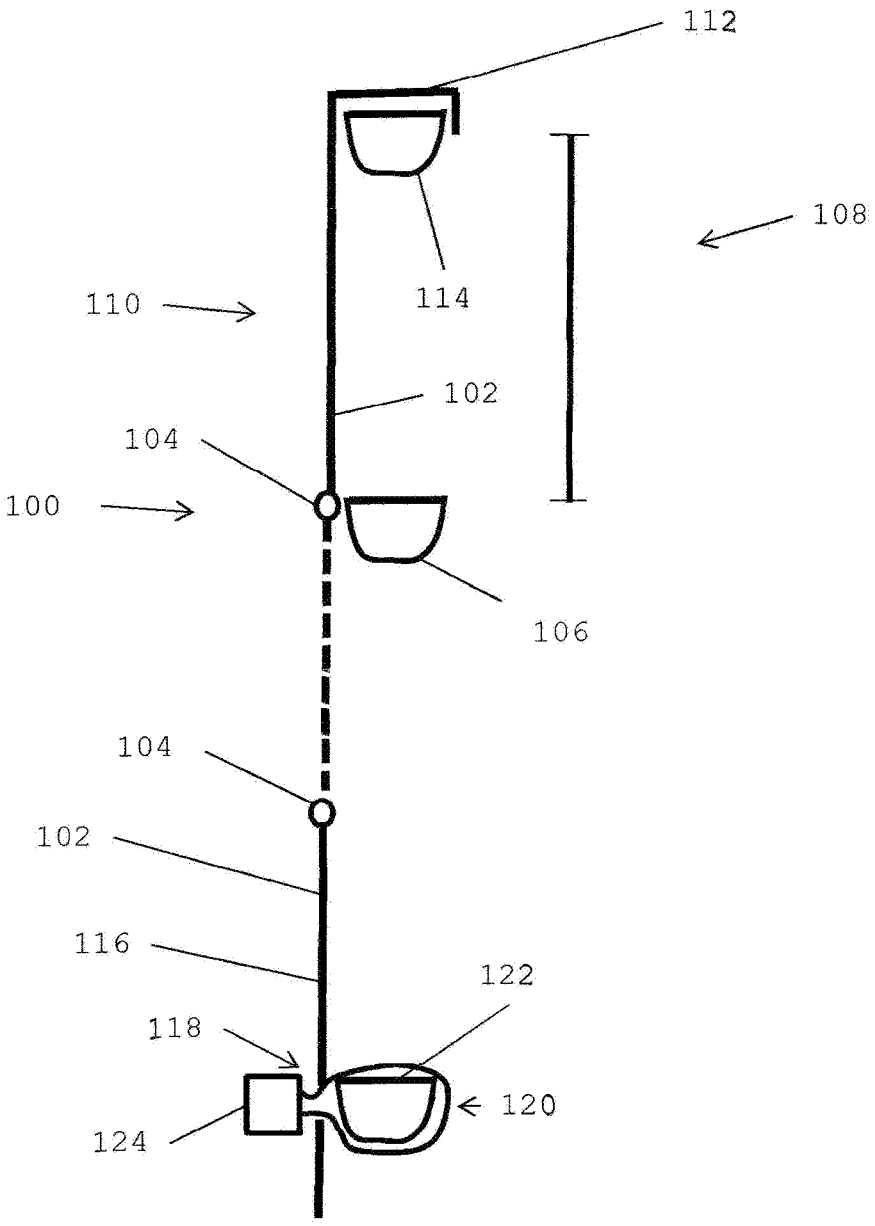
FIG. 1 is a side view of an accordion-style panel of the present invention.

Turning to the drawings, wherein like components are designated by like reference numerals throughout the various figures, attention is initially directed to FIG. 1 which illustrates a partial side view of an accordion-style safety device 100 constructed according to the present invention.

As best shown in FIG. 1, the accordion-style safety device 100 is composed of numerous "panels" with one or more subpanels 102. It should be understood that "panel" may be a solid panel or one having other elements therein to act as a safety panel. The subpanels 102 are approximately 6 to 12 inches in vertical height, approximately the distance from center to center of the step rails 114/106/122 of a conventional extension ladder 108, only partially shown, and the subpanels 102 are connected together by metal hinges 104 running from one side to other side of the step rail 106, being approximately 10 to 15 inches wide. A top panel 110 has a single hooking lip 112 that can be placed over a step rail 114 and has a vertical length "A" that allows the lower panels 102 to be folded together thereto for storage. A bottom panel 116 being also hinged has an aperture 118 through which a locking device 120 may be connected, either being a chain or cable with a lock 124 thereon. A longer cable or chain can be also used by wrapping the excess about the step rail 122. The panels 102 may be flexible sheet metal sufficient in strength to prevent permanent bending by hand or foot, ripping or easily cut. These panels provide sufficient area for warnings and advertising since the surface thereof is solid; the warnings or advertising may exceed the vertical length of any one panel. The panels may be painted with electric colors such as yellows, greens, reds, etc. Obviously the overall height of the device 110 must be sufficient to prevent children, young adults or adults from over stepping the panels when deployed.

Figure 2:
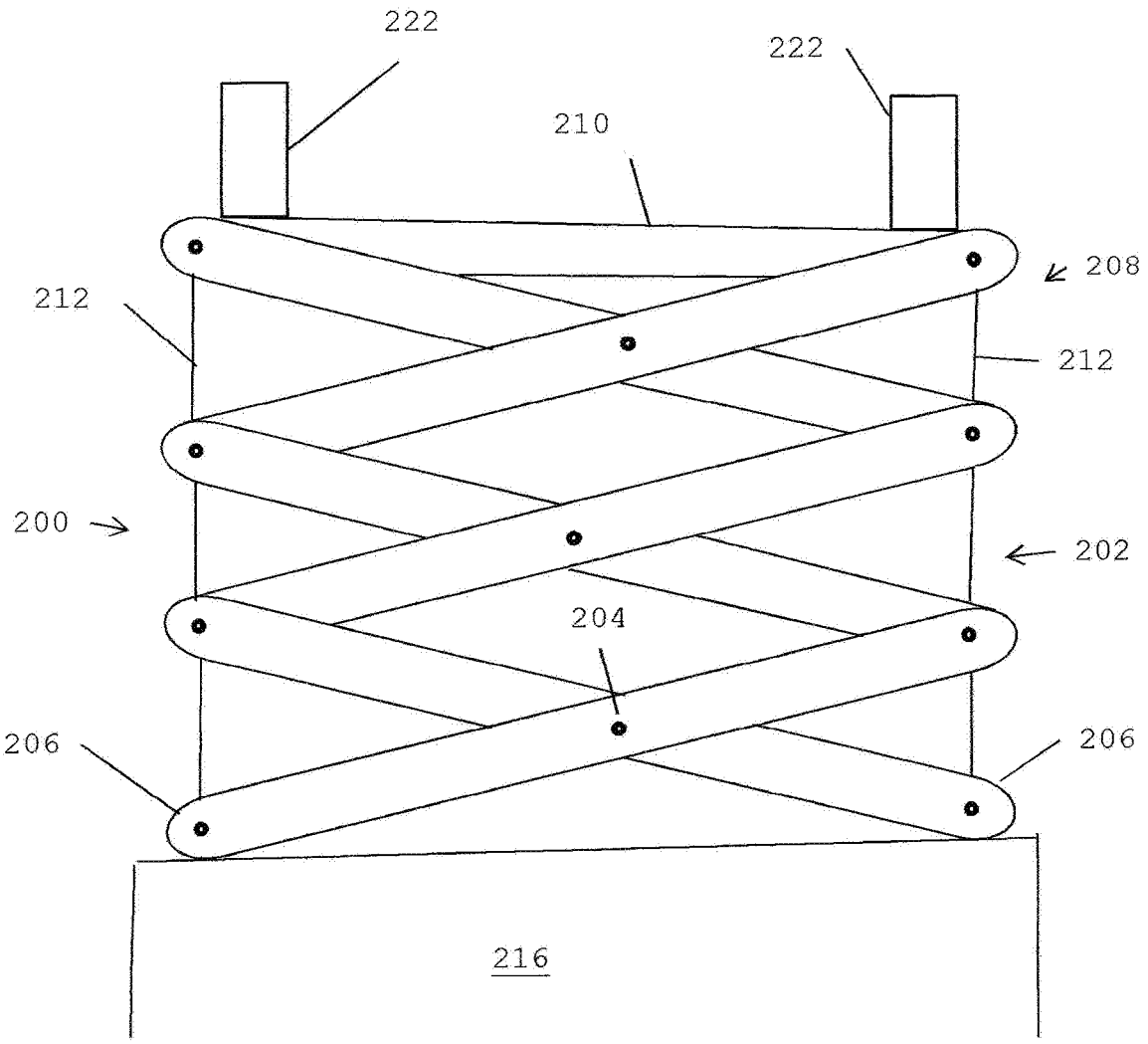
FIG. 2 is a partial side view of scissors-style panel of the present invention.

As best shown in FIG. 2, a scissors-style safety device 200 is partially shown as it is being drawn from a container 216. Each of scissors has cross arms 202 as shown. These are rotatively riveted together at a center point 204. The ends 206 are also rotatively pivoted to adjacent ends so as to provide a scissoring action. The last pair of arms 208 are riveted to a cross member 210 that is further connected to at least one rail hook 222. To provide further securement, a pair of wires 212 may also be connected to the ends of the arms 206 and to a take-up roller, not shown, in the container 216. The cross arms 202 may be made of metal or a strong plastic or a combination. The sizes would also be adjustable to meet the sizes of conventional extension ladders as noted above.

Figure 3:
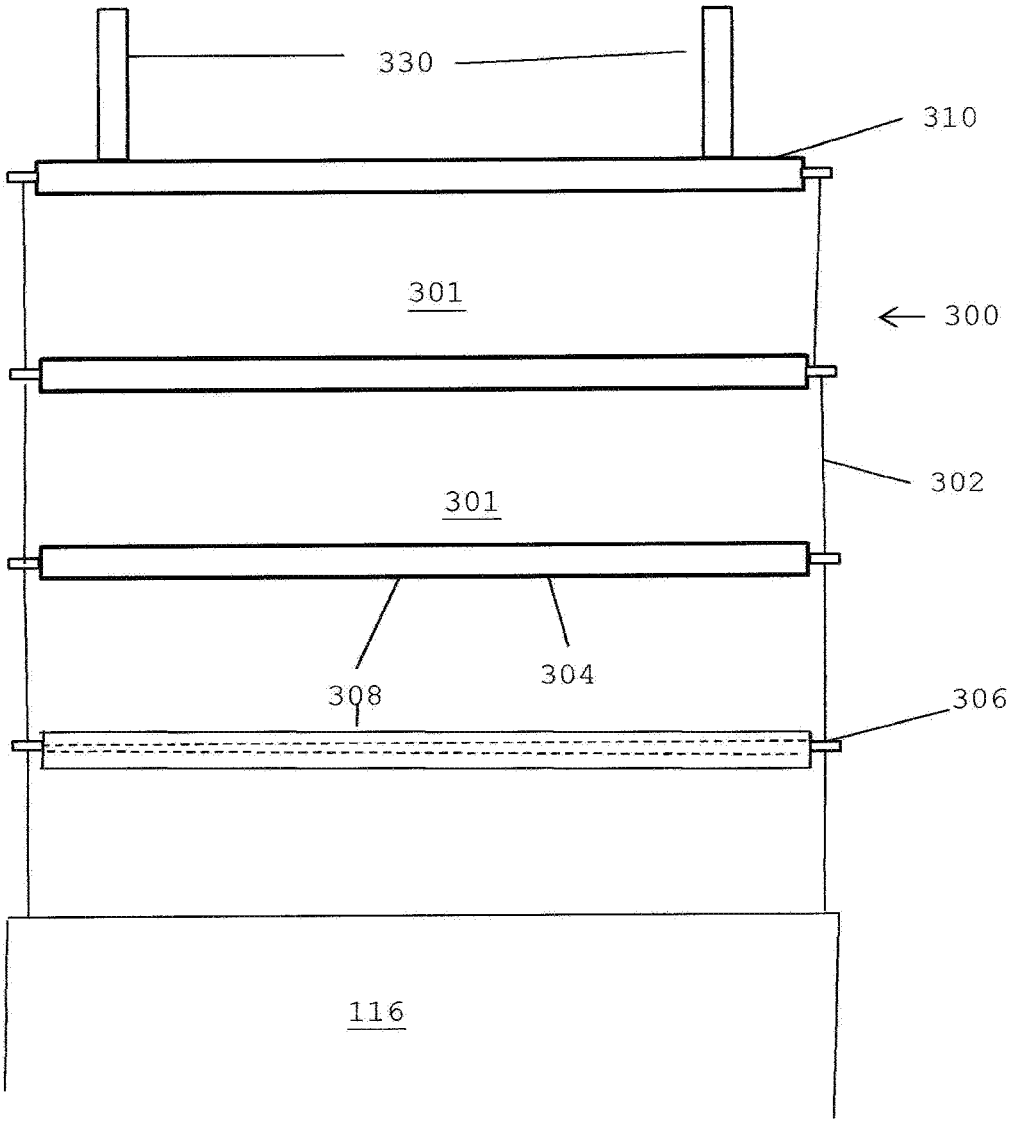
FIG. 3 is a top partial view of a chain-link-style panel of the safety device with roller bars of the present invention.

FIG. 3 illustrates a chain-link-style safety device 300 having multiple sections 301 having cables 302 that are fixedly connected to a plurality of rollers 304. An inside bar 306 in each roller, being non-bendable, is fixedly connected to the cables 302 and has a cylindrical tube 308 rotatably mounted thereon. These are closely spaced so that a foot can not be placed thereon and if a foot is placed thereon, the tubes 308 will roll. A takeup roller inside container 116 pulls the cables 302 therein with the rollers 308 going about the takeup roller. The last tube 310 is connected to hooks 330.

Figure 4A:
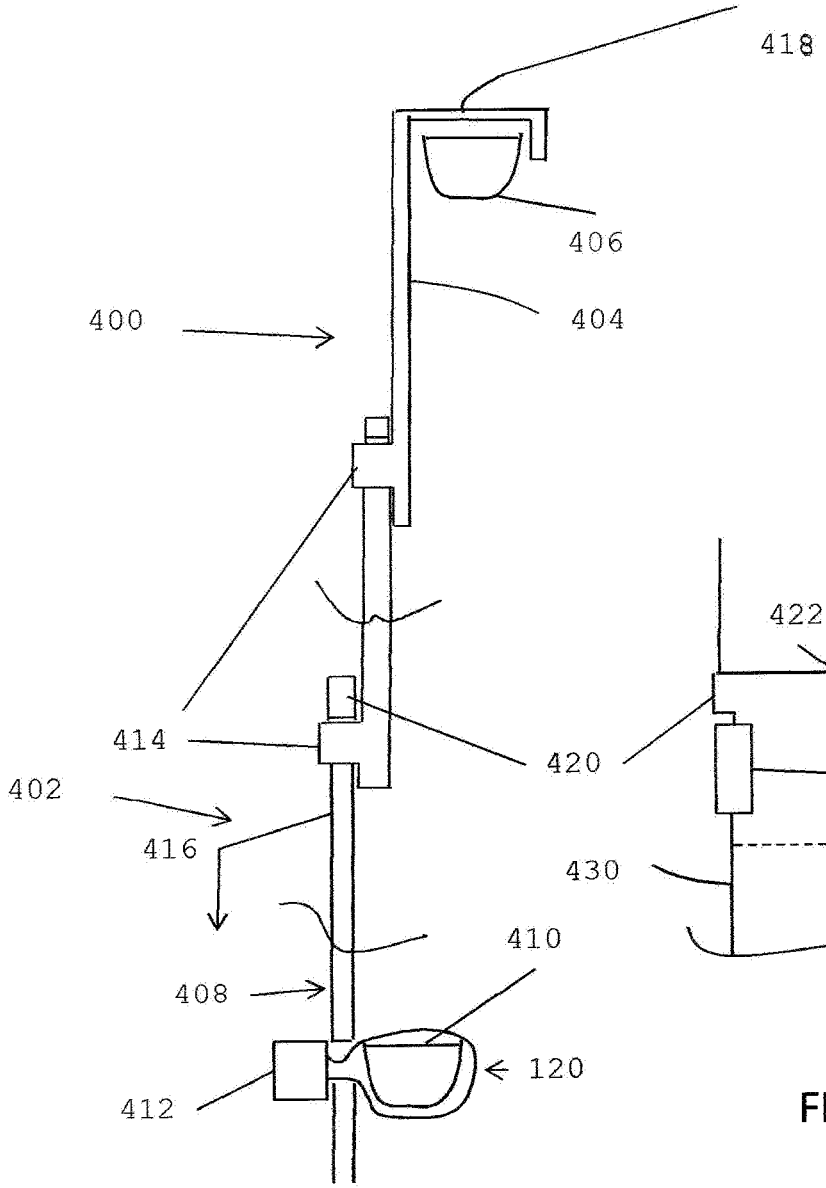
FIG. 4A is a partial side view of a telescoping-style panel.
Figure 4B:
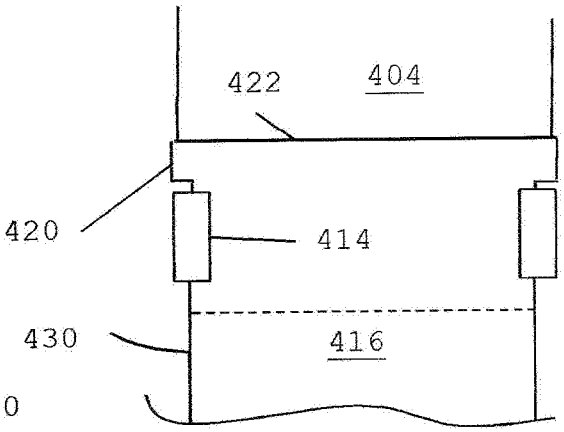
FIG. 4B is a partial front view of the telescoping-style panel of FIG. 4A
Figure 4C:
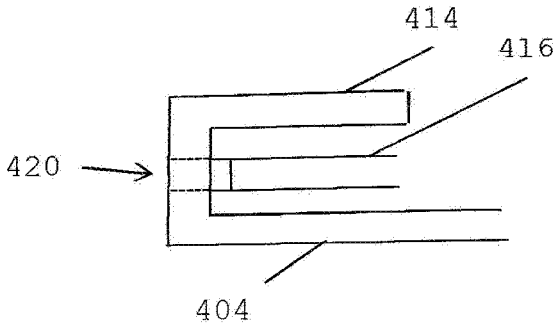
FIG. 4C shows the sliding bracket 414 being blocked by the tabs on the intermediate panels 416.

Referring to FIGS. 4A and 4B and 4C, a telescoping-style safety device 400 is shown. A plurality of panels 402 are in sliding relationship. A top panel 404 is removably connected to a step rail 406 of a ladder only partially shown. A bottom panel 408 is removably connected to a lower step rail 410 of the ladder by a locking means 412. The top panel 404 has a pair of sliding brackets 414 that are in sliding relationship to an adjacent upper panel 416 and a top mounting bracket 418 for mounting to the step rail 406. The sliding brackets 414, FIG. 4C, are L-shaped and fixedly attached to a lower panel and extend thereabout an upper panel. The panels are stacked one above the next. A plurality of intermediate panels 416 including a top panel 404 have a pair of tabs 420. The tabs 420 are fixedly mounted on a top 422 thereof of a top panel. The sliding brackets 414 are mounted to the intermediate panel and the tabs 420 prevent the sliding brackets 414 from being removed as the panels are pulled downwardly. A bottom panel 408 has means to lock 412 the safety device to the ladder. The bottom panel 408 has a pair of tabs 420 fixedly mounted on a top thereof, and engaged to an intermediate panel adjacent thereunder. Thus, the top panel 404 is capable of being mounted to a step rail 406 by said top mounting bracket 418. The intermediate panels 416 and the bottom panel 408 slide downward from the top panel 404 wherein said tabs 420 prevent the sliding bracket 414 thereon from being removed. The width of the panels having the tabs thereon is less than the width of the thickness of the sliding bracket 414 so that the brackets are blocked by the tabs on the upper part of the panels. The a pair of tabs wrap around an upper panel, and ride on cutout sections 430

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A safety device for preventing and/or warning persons not to climb upon an extension ladder, said safety device comprising:

two or more panels that are connected together for deployment on said extension ladder, one panel being a top panel and one panel being a bottom panel;

one or more hooks upon said top panel for connecting said safety device to a step rail of said extension ladder; and a locking means for securing said bottom panel to a step rail of said extension ladder;

wherein said safety device is a scissor safety device comprising:

a plurality of scissors, each scissor having a pair of cross arms, wherein each pair of cross arms is pivoted at the center thereof, and also pivoted to adjacent scissors at the ends thereof;

a top scissor having a cross member connected thereon;

said one or more hooks connected to said cross member and capable of being connected to a step;

a pair of side wires connecting the ends of said cross arms together;

a bottom scissor; and a housing having a take-up roller connected to said bottom scissors.

2. A safety device for preventing and/or warning persons not to climb upon an extension ladder, said safety device comprising:

two or more panels that are connected together for deployment on said extension ladder, one panel being a top panel and one panel being a bottom panel;

one or more hooks upon said top panel for connecting said safety device to a step rail of said extension ladder; and a locking means for securing said bottom panel to a step rail of said extension ladder;

wherein said safety device is a scissor safety device comprising:

a plurality of scissors, each scissor having a pair of cross arms, wherein each pair of cross arms is pivoted at the center thereof, and also pivoted to adjacent scissors at the ends thereof;

a top scissor having a cross member connected thereon;

said one or more hooks connected to said cross member and to a step;

a pair of side wires connecting the ends of said cross arms together;

a bottom scissor; and a housing having a take-up roller connected to said bottom scissor; and wherein said scissors are flexible and wherein said scissors are composed of metal or plastic or a combination of each.

* * * * *